United States Patent [19]

Ganguli

[11] Patent Number: 4,592,826

[45] Date of Patent: Jun. 3, 1986

[54] USE OF ETHERS IN THERMAL CRACKING

[75] Inventor: Partha S. Ganguli, Lawrenceville, N.J.

[73] Assignee: HRI, Inc., Gibbsboro, N.J.

[21] Appl. No.: 600,067

[22] Filed: Apr. 13, 1984

[51] Int. Cl.[4] ..... C10G 1/00; C10G 9/00

[52] U.S. Cl. ..... 208/407; 208/106; 208/428; 208/431

[58] Field of Search ..... 208/8 R, 106, 107, 8 LE, 208/87, 334, 11 R

[56] References Cited

U.S. PATENT DOCUMENTS

| | | | |
|---|---|---|---|
| 3,966,586 | 6/1976 | Owen et al. | 208/78 |
| 3,970,541 | 7/1976 | Williams et al. | 208/8 LE |
| 3,997,424 | 12/1976 | Uruqhart | 208/8 R |
| 4,035,285 | 7/1977 | Owen et al. | 208/120 |
| 4,089,658 | 5/1978 | Bay | 208/8 LE |
| 4,090,949 | 5/1978 | Owen et al. | 208/120 |
| 4,108,760 | 8/1978 | Williams et al. | 208/11 LE |
| 4,298,455 | 11/1981 | Huang | 208/106 |
| 4,405,437 | 9/1983 | Kulik et al. | 208/8 LE |
| 4,443,321 | 4/1984 | Compton | 208/8 LE |
| 4,483,761 | 11/1984 | Paspek, Jr. | 208/106 |

*Primary Examiner*—John Doll
*Assistant Examiner*—Lance Johnson
*Attorney, Agent, or Firm*—Fred A. Wilson

[57] ABSTRACT

A process for improving the upgrading/conversion of hydrocarbonaceous materials such as coals, petroleum residual oils, shale oils and tar sand bitumens. In the process, the free radicals formed from thermal cracking of the hydrocarbons are reacted with the free radicals formed by the thermal cracking of a free radical forming chemical reactant, such as dimethyl ether, to yield stable low molecular weight hydrocarbon distillate products. The hydrocarbonaceous feed material is preheated to a temperature of 600°-700° F. and the hydrocarbon and the free radicals forming chemical, such as dimethyl ether, are passed through a flow reactor at temperature of 750°-900° F., pressure of 200-1000 psi, and liquid hourly space velocity of 0.3 to 5.0 LHSV. Free radicals formed from the hydrocarbon feed material and from the ether material react together in the reactor to produce low molecular weight hydrocarbon liquid materials. The weight ratio of ether material to hydrocarbon feed material is between about 0.3 and about 2.0.

12 Claims, 3 Drawing Figures

USE OF ETHERS IN THERMAL CRACKING

BACKGROUND OF INVENTION

The present invention pertains to upgrading hydrocarbonaceous materials by their thermal reaction with ether compounds. It pertains particularly to non-catalytic upgrading hydrocarbonaceous materials by thermal reactions of hydrocarbon free radicals with methyl radical and hydrogen forming chemicals such as dimethyl ether, to produce lower boiling hydrocarbon liquid products.

The main reaction in conventional catalytic hydroconversion of hydrocarbonaceous materials, such as H-Coal® and two stage coal liquefaction processes is to indirectly or directly add a hydrogen atom to the free radicals formed by thermal cracking of coal, thereby stabilizing them. The major portion of the hydrogen atoms is obtained by abstraction of hydrogen atoms from a donor solvent, which has been hydrogenated catalytically under high hydrogen pressure. Due to mass transfer and kinetic limitations, the catalytic hydroconversion process requires high pressure and has limited efficiency.

In the processes of upgrading or conversion of hydrocarbons such as coal in a H-Coal® Process or a heavy oil, i.e., residual oil, in a H-Oil® Process, these processes have been carried out by catalytic hydrogenation in a reactor having a catalyst bed. In these processes, the use of added hydrogen has been quite common as shown in Johanson U.S. Pat. No. 3,679,573 for H-Coal® in that in the process disclosed therein, an ebullated catalyst bed was used which was composed of a particulate hydrogenation catalyst.

In the H-Coal® and the H-Oil® Processes, free radicals are formed by thermal cracking and stabilized by catalytic hydrogenation. The processes are carried out at a temperature ranging anywhere from 700° to 850° F. and using hydrogen at a rate of 5 to 300 SCFH/Lb coal and having a high pressure of about 1500–3000 psi.

It has now been found according to the present invention that these hydrocarbonaceous materials, i.e., coal and petroleum residual oils, may be upgraded without the use of added hydrogen and a catalyst bed. The present invention uses an ether material, which under a proper temperature and low pressure (i.e., 1000 psi and less) reacts with these hydrocarbons to yield low molecular weight hydrocarbon distillate products such as naphtha, heating oil fuel, diesel fuel and a high grade of petroleum oil.

SUMMARY OF INVENTION

The present invention provides a non-catalytic process for upgrading hydrocarbonaceous materials such as coal, residual oils, tar sand bitumens and shale oil to produce lower boiling hydrocarbon liquid products. According to the present invention, free radicals and hydrogen atoms formed by thermal decomposition of a suitable chemical will readily react with the free radicals formed by thermal cracking of the hydrocarbonaceous feedstocks to yield low molecular weight hydrocarbon distillate liquid. For example, at 750°–900° F. dimethyl ether decomposes to form the free radicals $CH_3$, $CH_3O$, $CH_2O$ and H:[1,2,3] as shown by the following equations:

$$CH_3OCH_3 \rightarrow CH^{3\bullet} + CH_3O^{\bullet}$$

$$CH_3O^{\bullet} \rightarrow CH_2O + H^{\bullet}$$

At 750°–900° F., free radicals from the thermal cracking of hydrocarbons such as in coal will readily react with the free radicals of $CH_3$, $CH_3O$ and H formed from dimethyl ether to produce low molecular weight hydrocarbon distillate products.

In the present invention, the term "hydrocarbon feed material" will be understood to include all hydrocarbonaceous materials useful as feed materials to the process, including coals, petroleum residual oils, shale oils and tar sand bitumens.

As disclosed by the invention, there is provided a non-catalytic process for the upgrading/conversion of hydrocarbon materials to produce low molecular weight hydrocarbon liquid distillate materials, which process comprises the steps of:

(a) preheating a hydrocarbon feed material to a temperature of 600°–700° F.;

(b) passing the hydrocarbon feed material through a reaction zone at a temperature of 750°–900° F. and a pressure of 200–1000 psi and forming hydrocarbon free radicals;

(c) injecting an ether material into the stream of hydrocarbon material fed into the reaction zone and forming ether free radicals; and (d) reacting the free radicals formed from the ether material with those free radicals formed from the hydrocarbon material in the reaction zone to produce low molecular weight hydrocarbon liquid distillate products.

The process according to the present invention is preferably carried out in a suitable continuous flow reactor wherein the hydrocarbon feed is passed through such reactor at a rate of about 0.3 to about 5.0 LHSV (liquid hourly space velocity). Suitable reactors could be a plug-flow reactor, an ebullated bed reactor or a stirred tank reactor.

DETAILED DESCRIPTION OF INVENTION

The upgrading of hydrocarbon materials according to the present invention is accomplished by a non-catalytic process using methyl radicals and hydrogen atom forming chemicals as reactants. Th process provides for upgrading hydrocarbon materials by reaction with an ether material such as dimethyl ether to produce lower boiling hydrocarbon liquid products.

According to the present invention, the hydrocarbon feed material after being preheated is passed through a reaction zone in which it is reacted with a free radical and hydrogen atom forming chemical such as dimethyl ether to yield low molecular weight hydrocarbon distillate products. The free radicals from the thermal cracking of the ether material and the hydrocarbon material react with each other to produce low molecular weight distillate products such as naphtha, heating oil, diesel fuel, a high grade of petroleum oil and gasoline.

Figure 1:
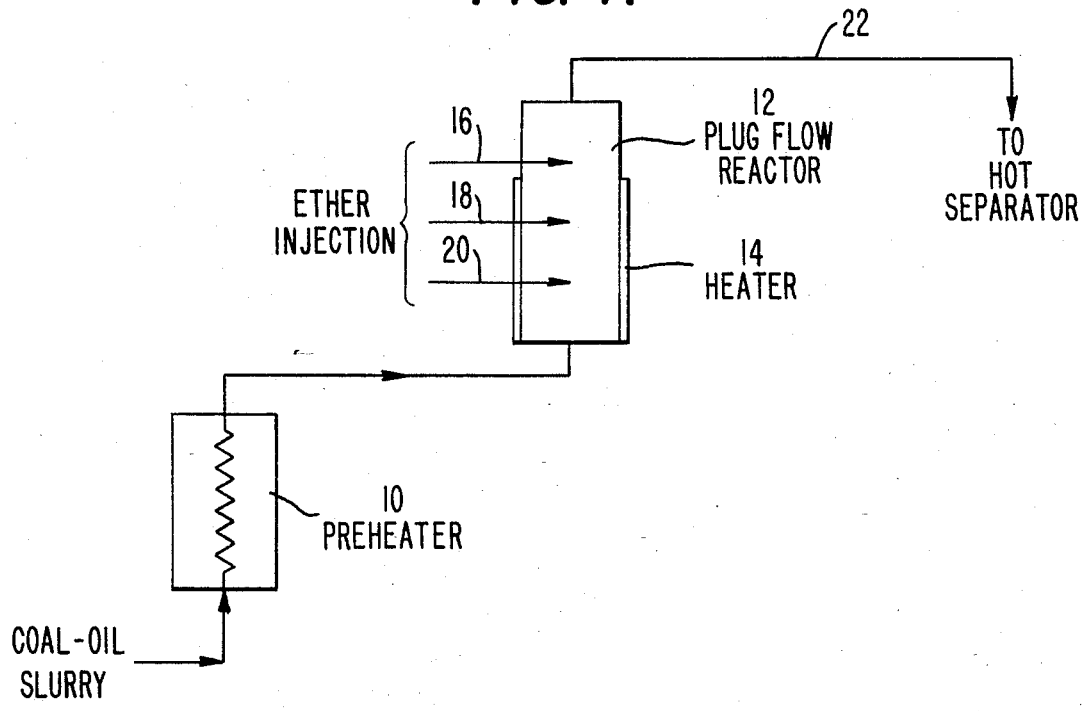
FIG. 1 is a flow diagram of an embodiment of the present process wherein a hydrocarbon feed material is upgraded in a plug-flow reactor.

As shown in FIG. 1, a solid hydrocarbonaceous feed material such as coal, is treated by first being mixed with an oil to form a slurry and then passed through a preheater 10, which heats the hydrocarbon slurry material to a temperature ranging from about 600° to about 700° F. After the hydrocarbon material has been preheated to a sufficiently high temperature, it is passed through a plug-flow reactor 12 which has a heater 14 surrounding its external wall. In the side of the hydrocarbon reactor 12, there are injection points 16, 18 and 20 through which the ether is fed or injected into the stream or flow of hydrocarbon feed material, e.g., coal slurry. As the feed material is being passed through the reactor 12, it is subjected to a temperature of 750° to 900° F. and a low pressure of 200 to 1000 psi as well as being reacted with the ether material. Under the conditions in the plug-flow reactor 12, free radicals are formed from both the ether material and the hydrocarbon feed material. These free radicals are reacted to produce low molecular weight hydrocarbon liquid distillate products.

The materials treated in the reactor 12 pass from the top of the reactor at outlet 22 to a hot separator (not shown) which is maintained at a temperature of approximately 600° F. The vapors from the hot separator pass through a light product cooler-condensor to a cold separator. The vent gas from the cold separator passes through a back-pressure control valve and is vented to a gas storage system. The light liquid product and the bottoms from the hot separator are flashed separately in vessels at atmospheric pressure. The vapors from the flash vessels are vented to a gas storage. The slurry product and the light liquid products (i.e., low molecular weight distillate products) are then collected. The slurry product is distilled to yield distillates.

Figure 2:
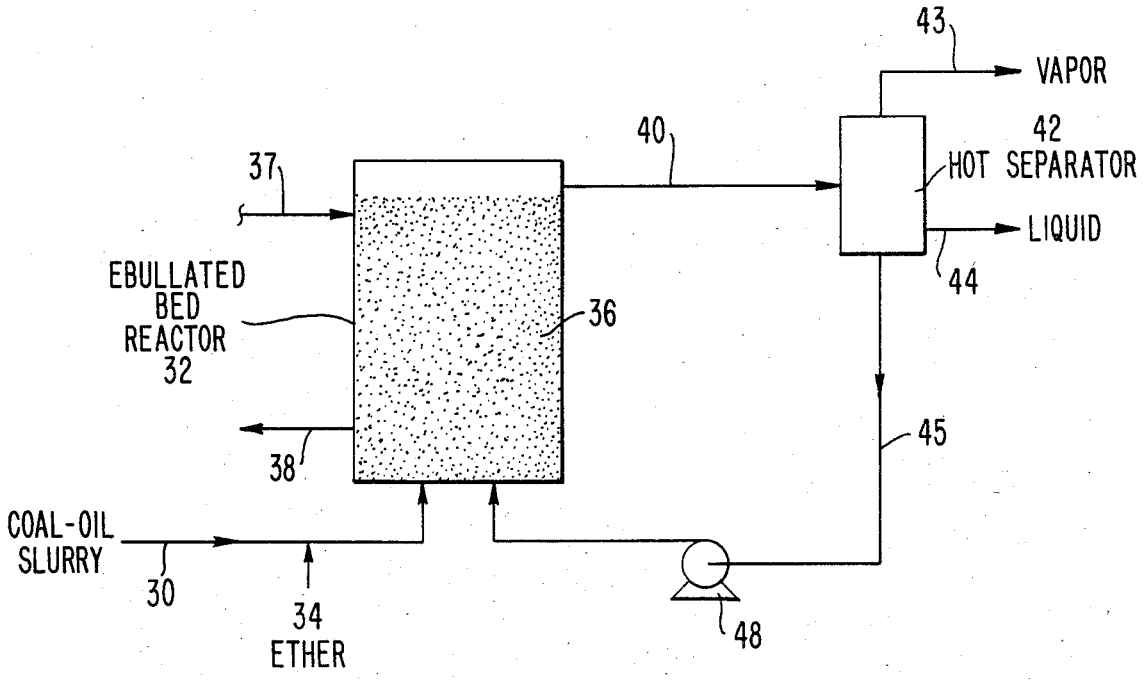
FIG. 2 is a flow diagram of the present process wherein a hydrocarbon material is upgraded in an ebullated bed reactor.

In FIG. 2, there is shown a second embodiment of the present invention, wherein a hydrocarbonaceous solid feed material is upgraded in an ebullated bed reactor. As shown in FIG. 2, a coal-oil slurry is passed through line 30 into the bottom of the ebullated bed of coal particles in reactor 32. Along with the coal-oil slurry there is an ether material provided through a line 34 into the coal-oil slurry line 30, and then both fed into the ebullated bed reactor 32. The reactor 32 has an ebullated bed 36 of particles in which the coal-oil slurry and ether material are reacted. The reactor effluent exits therefrom through outlet 40 into a hot separator 42. In the hot separator 42, the net effluent from reactor 32 is separated into a vapor product 43 and a liquid product 44. A portion of the liquid product is passed through recycle line 45 and through recycle pump 48 and returned to the bottom of the ebullated bed reactor 32. The vapor and liquid fractions are separated and collected in a product separator system (not shown).

Also as shown in FIG. 2, it is optional to have a known hydrocracking catalyst addition at inlet 37 and a catalyst withdrawal outlet 38. The catalyst addition inlet 37 and withdrawal 38 are provided only if desired, but according to the present invention they are not necessary.

The net effluent which is withdrawn through outlet 40 of reactor 32, flows to the hot separator 42, which is kept at a temperature of approximately 600° F. The vapors from the hot separator 42 pass through a liquid product cooler-condensor (not shown) to a cold separator (not shown). The vent gas from the cold separator passes through a back-pressure control valve and is then metered to a vent system. The light liquid product from the cold separator and the bottoms from the hot separator 50 are flashed in separator vessels (not shown) at atmospheric pressure. The vapors from the flash vessels are then metered and vented. The slurry product and the light liquid products (i.e., low molecular weight distillate products) are then collected.

Figure 3:
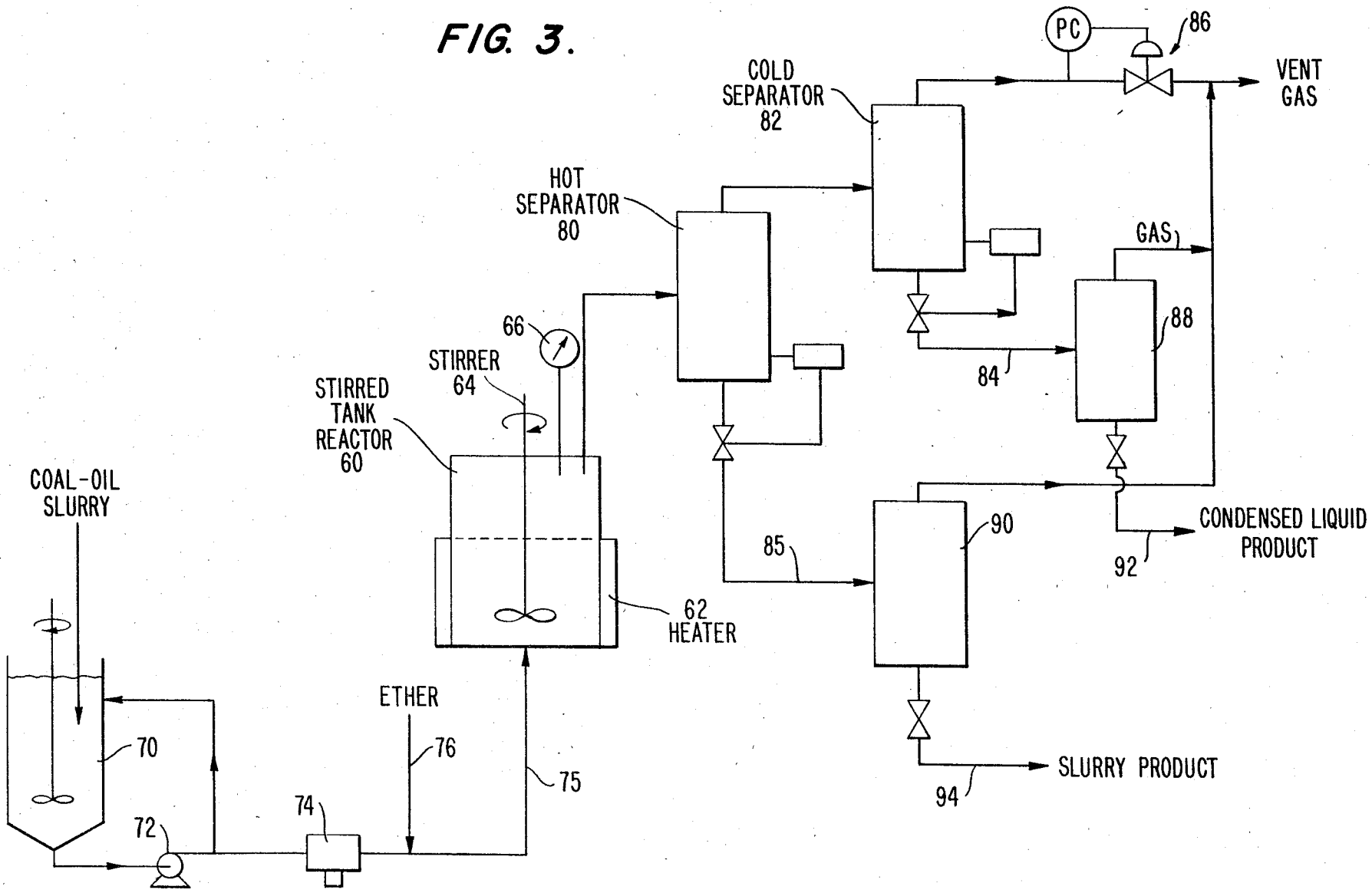
FIG. 3 is a flow diagram of the present process wherein a hydrocarbon material is upgraded in a stirred tank reactor.

Referring to FIG. 3, which is a flow diagram of a continuous flow reactor system, for upgrading hydrocarbonaceous feed materials and utilizing a stirred tank reactor 60 which is equipped with an electric heater 62, a magnedrive stirrer 64 and controls (not shown) to maintain the desired reactor temperature and stirrer speed. A thermocouple 66 connected inside the reactor 60 indicates the temperature thereof. The reactor 60 is maintained generally at a temperature of 750°-900° F. and a pressure of between about 350 and about 700 psig.

As shown in FIG. 3, a coal-oil slurry is mixed in charge pot 70 and passed through recycle pump 72 and then through feed pump 74 in line 75 into reactor 60. The ether material is fed into line 75 from line 76 and the coal-oil slurry and ether material are fed together into the bottom of the stirred tank reactor 60.

The net effluent from the reactor 60 flows to a hot separator 80, which is maintained at a temperature of approximately 600° F. The vapors from the hot separator 80 pass through a liquid product cooler-condensor (not shown), then to a cold separator 82. The gas from separator 82 passes through a backpressure control valve 86 and is vented to a gas storage system. The light liquid fraction 84 from the cold separator 82 and the separator bottoms slurry 85 from the hot separator 80 are flashed separately in vessels 88 and 90, respectively, at atmospheric pressure. The vapors from the flash vessels 88 and 90 are metered and vented to a gas storage system. The slurry product 94 from flash vessel 90 and the light liquid product 92 from flash vessel 88 are collected. The slurry product is subjected to distillation to yield distillate products.

In the present process, the hydrocarbonaceous materials that may be reacted with an ether material in a non-catalytic process are coals, residual oils, shale oils and tar sand bitumens. In processing these hydrocarbons, generally for each ton (i.e., 2000 pounds) of hydrocarbon material there is utilized between about 400 and about 800 pounds of ether material.

The ether material that may be used is a dimethyl ether or a diethyl ether. Other ethers may be used according to the present invention which have been found to be effective in the upgrading and conversion of hydrocarbons.

In the upgrading/conversion of the hydrocarbon feed material, for every ton of coal that is reacted, there are produced between about 4.0 and 6.0 barrels of low molecular weight liquid product. The weight ratio of ether material to hydrocarbon feed material may range from about 0.3 to about 2.0.

The hydrocarbon feed when being passed through the reaction zone (i.e., a suitable continuous flow reactor), is generally passed through at a rate ranging from about 0.3 to about 5.0 LHSV (liquid hourly space velocity). Suitable reactors are a plug-flow an ebullated bed or, a stirred tank type reactor. The hydrocarbon feed material is subjected to a reaction temperature of between 750° and 900° F. with a preferable range of between about 800° and about 850° F. The pressure utilized is a low pressure of between about 200 and about 1000 psi. and preferably between about 400 and about 800 psi.

In the injection of the ether material into the flow or stream of hydrocarbon material which is passed through and treated in a reactor, e.g., the plug-flow reactor 12 of FIG. 1, the amount of ether that is admitted into each point or position in the hydrocarbon feed stream is generally divided equally. That is, if 600 pounds of ether material are injected into the stream, and there are three points through which the ether material is fed, 200 pounds of the ether will be fed through each of the injection points, i.e., 16, 18 and 20.

In providing a process which is both non-catalytic and not requiring any added hydrogen, there are advantages of reduced overall costs in the upgrading of hydrocarbons. As an estimate, the cost to produce a useable product is generally between one third and one half of the cost that would be necessary to convert or upgrade a hydrocarbon material where a catalyst and hydrogen are utilized. In this case, both the use of an ether material as a reactant and that there is no catalyst, provides the following advantages over the prior art hydrocarbon hydroconversion processes (e.g., H-Coal ® and H-Oil ® Processes):

(1) the liquid product of the present process will have a high stability because the phenols in the liquid product are in the methylated form;

(2) the presence of the alkyl ether groups enhance the octane value of the naphtha products;

(3) the process being non-catalytic reduces the overall process cost due to avoiding catalyst and catalyst disposal;

(4) the operating pressure is low, i.e., below 1000 psig, and such low pressure reduces the overall cost for the upgrading of the hydrocargon material;

(5) there is a short residence time for the hydrocarbon feed material and the ether in the reactor which also reduces the overall cost of the process;

(6) a greater amount of low molecular weight distillate products are produced, e.g., at least 5.0 to 6.0 barrels per ton of coal as compared with the other processes where only 3.5 barrels are produced by the conventional H-Coal ® process; and (7) there is a negligible amount of water and $C_1$–$C_3$ hydrocarbons formed which will tend to reduce the overall cost of the process.

The following examples illustrate more specifically the process based on the present invention and the advantages thereof.

EXAMPLE 1

UPGRADING OF COAL

In order to show the effectiveness of the present process, as Illinois No. 6 coal, a coal derived hydrocarbon solvent and dimethyl ether (DME) are processed in a single stage stirred tank reactor. The reactor is maintained at a temperature of 870° F. and a 500 psig pressure for a period of about 10 minutes. As a result, coal derived hydrocarbon liquids are produced.

Based on this experiment, the following estimates are made for the quantity and quality of liquids produced from a large scale processing of coal with dimethyl ether (DME):

| | LB |
|---|---|
| FEED | |
| Illinois No. 6 Coal | 100.00 |
| Dimethylether (DME) | 44.00 |
| | 144.00 |
| TOTAL PRODUCT | |
| $H_2S$ | 2.64 |
| $NH_3$ | 1.08 |
| $H_2O$ | 0 |
| CO, $CO_2$ | 0.48 |
| $H_2$ | 0.48 |
| CO | 6.69 |
| $C_1$ | 0 |
| $C_2$ | 0 |
| $C_3$ | 0 |
| Unconverted Coal | 5.78 |
| Ash | 11.78 |
| Oil | 115.34 |
| | 144.00 |
| LIQUID PRODUCT | |
| Bbls/Ton of Coal | 5.71 |

A similar experiment is performed in which nitrogen was used instead of dimethyl ether. In that experiment, there is no evidence of any coal derived liquid production.

EXAMPLE 2

UPGRADING OF RESIDUAL OIL

In order to show the effectiveness of the present process in the upgrading of petroleum residual oils, a residual oil, i.e., Kuwait Vacuum Bottoms, is treated by the process of the present invention. In this process, the Kuwait Vacuum Bottoms is treated with dimethyl ether in a single stage stirred tank reactor and processed at a temperature of 850° F. and a pressure of 500 psig. The residual oil, i.e., Kuwait Vacuum Bottoms, and the dimethyl ether are both passed through the stirred tank reactor at a rate of about 1.0 LHSV.

In the process, the following feed is treated in the reactor:

| FEED | LBS |
|---|---|
| Kuwait Vacuum Bottoms (BP: 975° F.) | 100 |
| Dimethyl ether (DME) | 40 |
| | 140 |

As a result of such treatment, the following products are produced:

| PRODUCTS | LBS |
|---|---|
| $H_2S$ and $NH_3$ | 6.5 |
| CO + $H_2$ | 0.5 |
| Oil ($C_4$-975° F.) | 108 |
| Residua (975° F.+) | 25 |
| | 140 |

I claim:

1. A non-catalytic process for upgrading hydrocarbon materials to produce lower boiling hydrocarbon liquid products, comprising the steps of:

(a) preheating a hydrocarbon feed material to a temperature of 600°–700° F.;

(b) passing the hydrocarbon feed material through a reaction zone at a temperature of 750°–900° F. and a pressure of between about 200 to about 1000 psi, thermally cracking the hydrocarbon feed material, and forming free radicals therein;

(c) injecting an ether material into the stream of hydrocarbon material in the reaction zone and forming ether free radicals therein; and (d) reacting the free radicals formed from the ether material with those free radicals formed from the hydrocarbon material in the reaction zone to produce lower boiling hydrocarbon products.

2. The hydrocarbon upgrading process of claim 1, wherein said hydrocarbon feed material is passed through the reaction zone at a rate of about 0.3 to about 5.0 LHSV (liquid hourly space velocity).

3. The hydrocarbon upgrading process of claim 1, wherein the reaction zone is a plug-flow type reactor.

4. The hydrocarbon upgrading process of claim 1, wherein the weight ratio of ether material to hydrocarbon feed material ranges from about 0.3 to about 2.0.

5. The hydrocarbon upgrading process of claim 1, wherein said hydrocarbon feed material and ether material are subjected to a temperature of between about 800° and 850° F. and a pressure of between about 400 and about 800 psi for forming the free radicals.

6. The hydrocarbon upgrading process of claim 1, wherein said hydrocarbon feed material is selected from the group consisting of coal, petroleum residua oil, shale oil, and tar sand bitumens.

7. The hydrocarbon upgrading process of claim 1, wherein said ether material is dimethyl ether.

8. The hydrocarbon upgrading process of claim 1, wherein the reaction zone is an ebullated bed type reactor.

9. The hydrocarbon upgrading process of claim 1, wherein the reaction zone is a stirred tank type reactor.

10. The hydrocarbon upgrading process of claim 1, wherein the hydrocarbon materials produced in the reaction zone are withdrawn and phase separated to produce vent gases and hydrocarbon distillate liquid products.

11. A non-catalytic process for upgrading hydrocarbon materials to produce lower boiling hydrocarbon liquid products, comprising the steps of:

(a) preheating a hydrocarbon feed material to a temperature of 600°–700° F.;

(b) passing the preheated hydrocarbon feed material through a reaction zone at a temperature of 750°–900° F., a pressure of between about 200 and 1000 psi and at liquid hourly space velocity of about 0.3 to about 5.0, thermally cracking the hydrocarbon feed material and forming hydrocarbon free radicals;

(c) injecting dimethyl ether material into the stream of hydrocarbon material without added catalyst in the reaction zone and forming ether free radicals therein, the weight ratio of the ether material to the hydrocarbon feed material being from about 0.3 to about 2.0;

(d) reacting the free radicals formed from the ether material with those free radicals formed from the hydrocarbon material in the reaction zone to produce lower boiling hydrocarbon materials; and (e) phase separating and distilling the hydrocarbon materials to produce distillate liquid products.

12. A non-catalytic process for upgrading hydrocarbon materials to produce lower boiling hydrocarbon liquid products, comprising the steps of:

(a) preheating a coal-oil slurry feed material to a temperature of 600°–700° F.;

(b) passing the preheated feed material through a reaction zone at a temperature of 750°–900° F., a pressure of between about 200 and 1000 psi, and liquid hourly space velocity of about 0.3 to about 5.0 and forming hydrocarbon free radicals therein;

(c) injecting a dimethyl ether material into the hydrocarbon material in the reaction zone without added catalyst and forming ether free radicals therein; the weight ratio of the ether material to the coal and oil hydrocarbon feed material being from about 0.3 to about 2.0;

(d) reacting the free radicals formed from the ether material with those free radicals formed from the hydrocarbon material without added catalyst in the reaction zone to produce lower boiling hydrocarbon materials; and (e) phase separating and distilling the hydrocarbon materials to produce distillate liquid products.

* * * * *